US010308471B2

(12) United States Patent
Harrold

(10) Patent No.: US 10,308,471 B2
(45) **Date of Patent: *Jun. 4, 2019**

(54) FIRE HOSE PACK ROLLER

(71) Applicant: Chris Harrold, Chula Vista, CA (US)

(72) Inventor: Chris Harrold, Chula Vista, CA (US)

( * ) Notice: Subject to any disclaimer, the term of this patent is extended or adjusted under 35 U.S.C. 154(b) by 153 days.

This patent is subject to a terminal disclaimer.

(21) Appl. No.: 15/229,145

(22) Filed: Aug. 5, 2016

(65) Prior Publication Data

US 2017/0129734 A1 May 11, 2017

Related U.S. Application Data

(60) Provisional application No. 62/215,466, filed on Sep. 8, 2015.

(51) Int. Cl.

| | |
|---|---|
| ***B65H 54/58*** | (2006.01) |
| ***A62C 33/04*** | (2006.01) |
| ***A62C 33/00*** | (2006.01) |
| ***B65H 75/22*** | (2006.01) |
| ***B65H 75/28*** | (2006.01) |
| *A62C 33/02* | (2006.01) |

(52) U.S. Cl.

CPC ..... *B65H 54/585* (2013.01); *A62C 33/00* (2013.01); *A62C 33/04* (2013.01); *B65H 75/22* (2013.01); *B65H 75/28* (2013.01); *A62C 33/02* (2013.01); *B65H 2701/332* (2013.01)

(58) Field of Classification Search

CPC ..... B65H 54/585; B65H 75/22; B65H 75/28; A62C 33/00

See application file for complete search history.

(56) References Cited

U.S. PATENT DOCUMENTS 4,265,414 A * 5/1981 Spradling ..... B65H 75/40 242/397.5

5,205,509 A * 4/1993 Noggle ..... A62C 33/04 242/406

* cited by examiner

*Primary Examiner* — Sang K Kim

(74) *Attorney, Agent, or Firm* — Mark Wisnosky

(57) ABSTRACT

The fire hose pack roller includes a first embodiment where the device is held in place by a bracket positioned under a vehicle's tire and the weight of the vehicle secures the device for use or in a second embodiment where the device is removably mounted to the vehicle. The hose pack roller device includes a pair of collapsible arms that are unfolded and the fire hose is would around pegs mounted on the arms. The device further includes a set of rollers that squeezes air and water from the hose as it is wound. Once wound the hose is easily folded into a Gansner type pack for storage of the hose. The arms of the device may be folded closed such that the device forms a compact unit for storage. No external power supply is required.

6 Claims, 12 Drawing Sheets

FIRE HOSE PACK ROLLER

CROSS-REFERENCE TO RELATED APPLICATIONS

This application claims priority to U.S. Provisional application 62/215,466, entitled Fire Hose Pack Roller, Filed Sep. 8, 2015, by the same inventor.

BACKGROUND OF THE INVENTION

Technical Field

The present invention relates to roller system that is used to roll up and pack fire hoses.

Related Background Art

A typical fire trucks carries hundreds of feet of fire hose, connectors, nozzles, pumps, water supplies, foam fire retardant supplies, ladders, emergency medical equipment and a host of ancillary equipment. It is important that all of this is readily accessible and packed in such a manner that it is not damaged and can be re-packed after use. The truck will often carry several different diameter and length of fire hose. It is critical that the hose is packaged such that it can be accessed and unrolled at a fire and that it can be quickly re-packed. The hose is rated to carry water supply or other fire retardants at pressures up to several hundred pounds per square inch. The hose cannot be damaged during the unpacking or repacking or storage. The length of the hose and the limited space on a fire truck requires that it be packed tightly with no water or air residual in the hose after use. Quick unrolling and being able to rapidly charge the hose with water is also a requirement. New ways to pack a hose, such as Gansner and Gnass packs, have been introduced that enable the hose can be quickly laid on the ground with access to both end fittings and can be charged to high pressure without the need to unroll the hose completely. There is a need for an easily used device that can repack a hose into these configurations. Ideally the device requires no separate power supply, and can be easily stored away on the fire truck where space is at a premium. The device also needs to handle different lengths and diameters of hoses as are typically carried aboard the fire truck.

The present invention comprises innovations that address the needs for a fire hose roller.

DISCLOSURE OF THE INVENTION

The present invention provides a new design for a fire hose pack roller. The device is portable, does not require a power supply. The invented device folds up to a compact configuration that can easily be stored away. In one embodiment the device requires no mounting as a stand is provided that fits under the fire truck tire to be held securely while in use. The device can handle multiple lengths of hose and includes means to squeeze water and air from the hose as it is rolled to be folded into a pack. The device rolls the hose into configurations that make it easy to form a Gansner pack for storage. The invented device also includes configurations for mounting on the fire truck in cases where that is more convenient than the under wheel stand. The device disassembles for storage. In one embodiment the device has two configurations for two different lengths of hose. In another embodiment the device can be continuously adjusted for different hose lengths.

DETAILED DESCRIPTION

Figure 1:
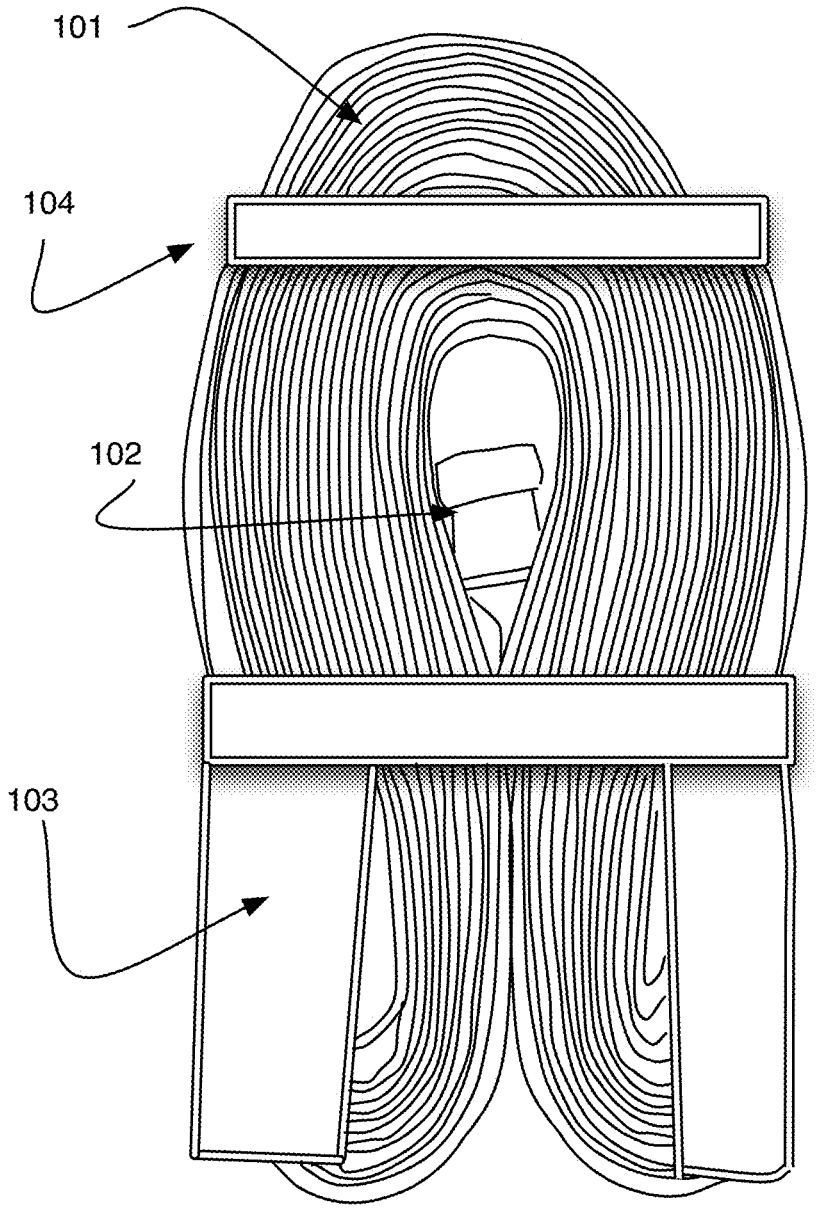
FIG. 1 shows a hose pack created using the invented hose pack roller device.

Referring now to FIG. 1, a Gansner pack created using the instant invention is shown the fire hose 101 is rolled into a large coil and then folded to fit into the pack the end fittings 102, only one of which is seen fit within the folds of the fire hose and the pack is held together by straps 104 and covers 103. The covers help to protect the hose and fitting from abrasion during storage. It is important that the dimensions of the pack are uniform from pack to pack so that multiple hose packs can be stored into a minimal space. The pack design is easily unrolled and can be quickly charged with water in a fire-fighting situation.

Figure 2:
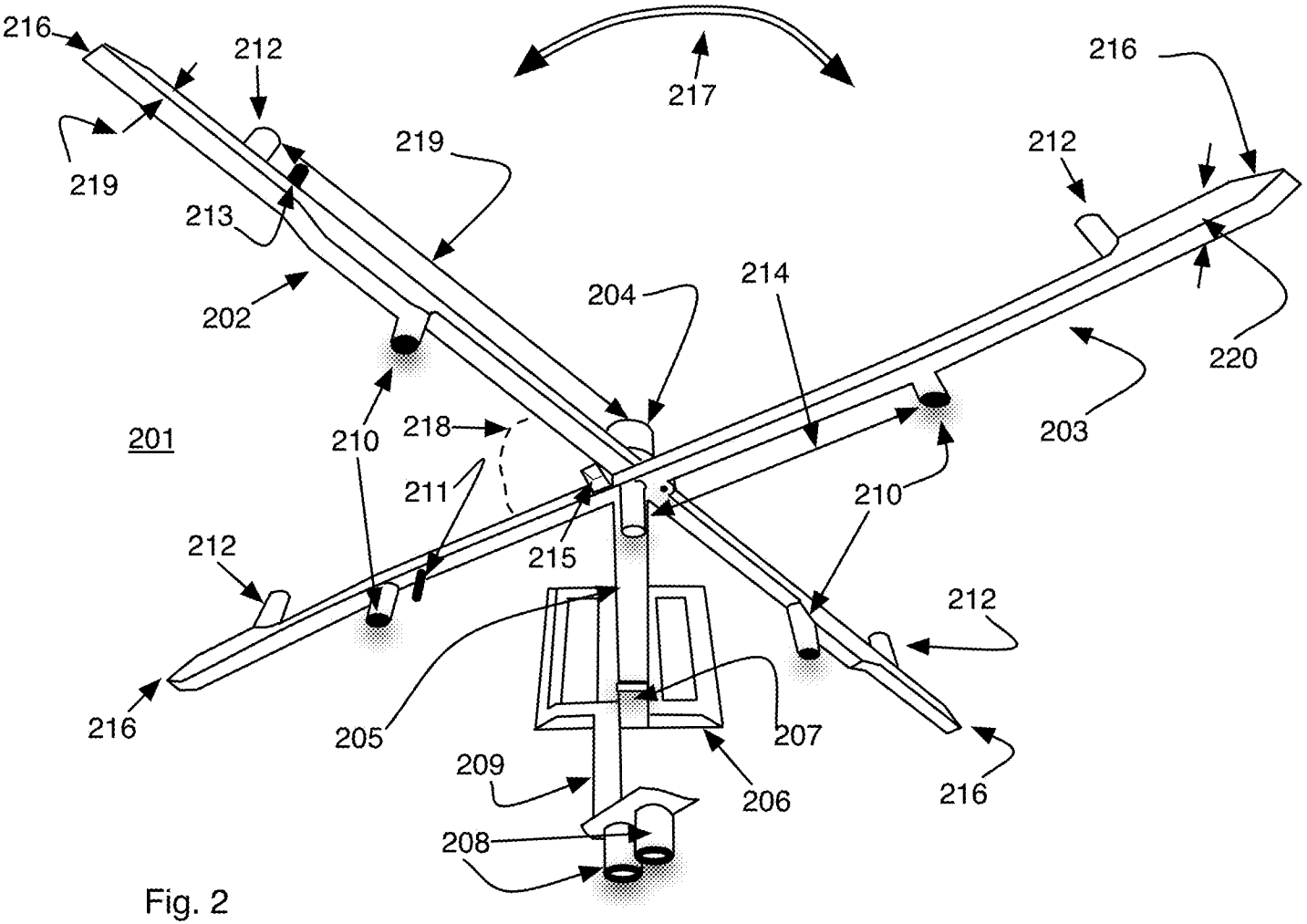
FIG. 2 shows a first embodiment of the hose pack roller device set up for two hose lengths.

FIG. 2 shows a front view of the invented fire hose pack roller 201. The fire hose pack roller is comprised of a pair of arms 202, 203 that are joined at the center 204 using a shaft such that they can be rotated in the direction shown 217. The arms 202, 203 shown in the position ready for use are opened against a stop 215 such that the arms 202, 203 are perpendicular to one another. The angle 218 is about 90 degrees. The thicknesses of the arms 219, 220 are varied such that thicker 220 and thinner 219 regions mesh together to provide more compact packing when the arms are folded together for storage. Only one such section is shown where the thinner region 219 on the first arm 202 will align with the thicker region 220 on the second arm 203 when the arms are folded together such that the angle 218 is essentially 180 degrees. Other such matching regions are seen in the drawing but not labeled. The arms are rotatably attached to a support 205 that is in turn mounted in a fitting 207 to a base stand 206. The base stand 206 is sized to fit under the tire of a vehicle. The weight of the vehicle holds the stand securely while the hose pack roller is in use. The base further includes a horizontal support 209 to which is attached a pair of rollers 208. The fire hose is threaded through the pair of rollers 208 when in use such that as the hose is pulled through the rollers residual water and air are squeezed from the hose as it is rolled up. The arms 202, 203 each include pegs 210, 212 around which the fire hose is wrapped during use. In the embodiment shown there are a first set of pegs 210 on the front of the arms, each peg spaced a distance 214 from the center point 204 where the arms are joined. There is a second set of pegs 212 on the back of the arms, each spaced a distance 219 from the center joining point 204. In the preferred embodiment the distances 219, 214 are not equal. One side of the arms is used for a first length of hose and the other side of the arms is used for a second length of hose. The pegs that are on the opposite side of the stand 206 are used. In the Figure as shown, the first set of pegs 210 would be used. The arms are removably attached to the support 205 and may be attached so that either set of pegs 210 or the set of pegs 212 may be positioned on the side opposite the base 206. In this manner the hose roller may be set up for a longer hose using the second set of pegs 212 or for a shorter hose using the first set of pegs 210. In another embodiment (not shown) the pegs are removable and may be placed at any position along the arms to accommodate different lengths of hose. In the preferred embodiment shown in the Figure the pegs are at fixed positions such that consistent packs are obtained hose after hose. In another embodiment the arms have a single set of pegs on one side of the arms and different arms with different spacing's are used for different hose lengths. The ends 216 of the arms are tapered to a point to avoid having the fire hose snag on the ends as it is rolled onto the pegs. The arms further include at least one additional peg 211, 213 on each side that is spaced a distance from its nearest hose peg 210, 212 respectively a distance such that the hose can fit between the pair 210, 211 or 212, 213 but the hose end fitting cannot thereby capturing the end fitting to hold the end of the hose as the device is rotated in the direction 217 and thereby rolling the hose over and around the pegs 210, 212.

Figure 3:
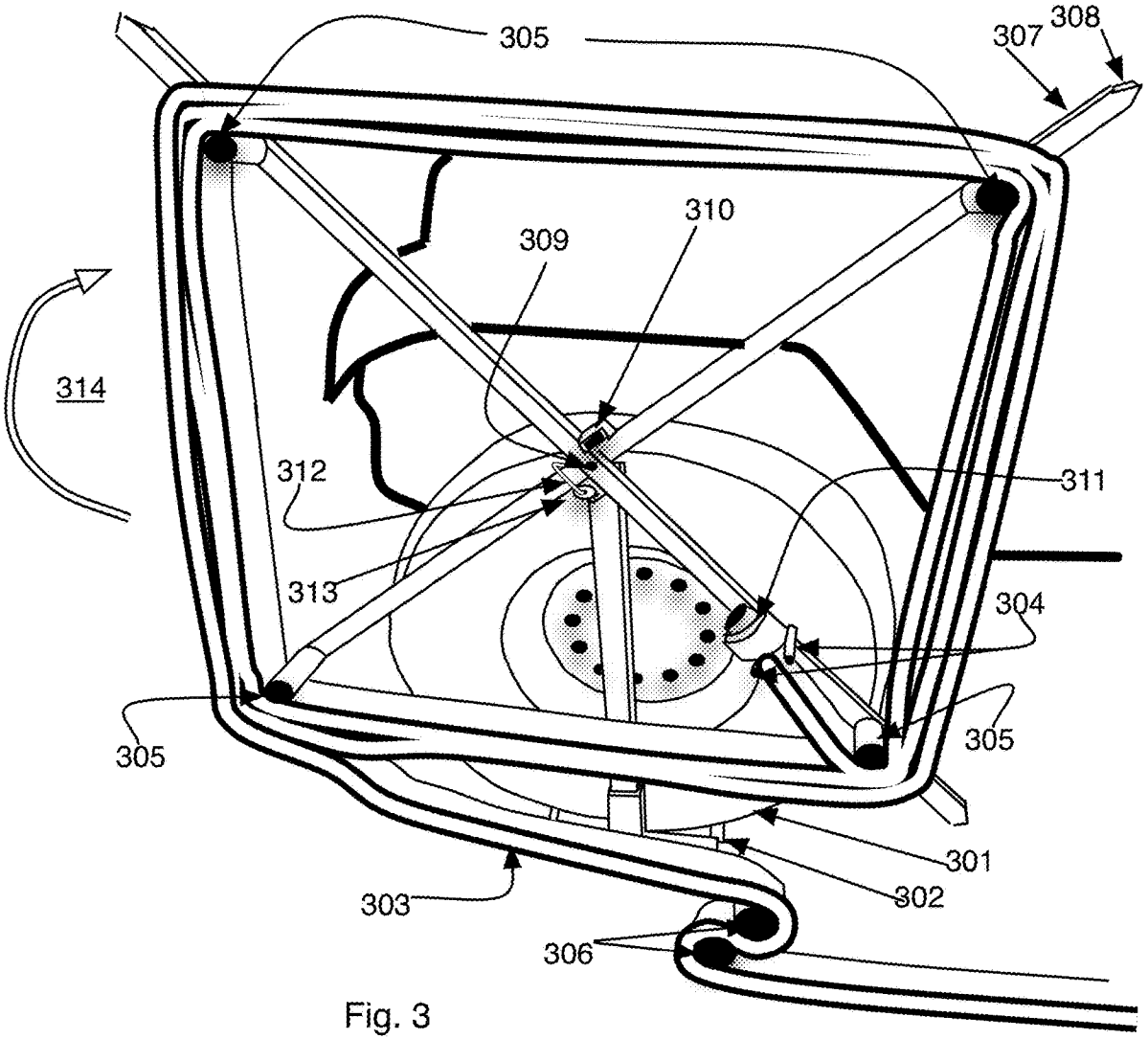
FIG. 3 shows an embodiment of the hose pack roller device being used to roll a hose pack.

FIG. 3 shows the hose pack roller as it is being used to wrap a hose. A vehicle is positioned such that its tire 310 is on top of the base 302 to securely hold the device in place. The fire hose 303 is threaded through the pair of rollers 306. The fire hose is further threaded through a pair of pegs 304 on one of the arms. The pegs 304 are spaced such that the hose fits between the pegs but the end fitting 311 does not. Thereby holding the hose as it is wrapped around the other pegs 305 on the arms of the device when the arms are rotated in the direction 314 shown. Note that this configuration is a second embodiment of the pegs 304. It is different from that shown in FIG. 2 where instead of a pair of pegs 304 the device included a single peg 211, 213 spaced a distance from one of the pegs 210, 212 upon which the hose is wrapped. As the arms of the hose roller are rotated in the direction 14 shown, the hose is pulled through the rollers 306 which squeeze out air and water and the hose is wrapped over the pegs 305. Once the entire length of the fire hose is wrapped it is removed from the pegs 305 and folded to form the pack shown in FIG. 1. The ends of the arms 307 (only one of 4 labeled) include sufficient distance beyond the peg 305 to accommodate the entire hose pack. The end tips 308 of the arms are tapered to prevent snagging of the hose on the arms as it is wrapped onto the pegs 305. The arms are joined at a pivot point 309 opened to 90 degrees as shown against a stop 310 and locked in place with a pin 312 extending through cylinders 313 attached to each arm. Details of the central portion of the roller are seen in a later drawing.

Figure 4:
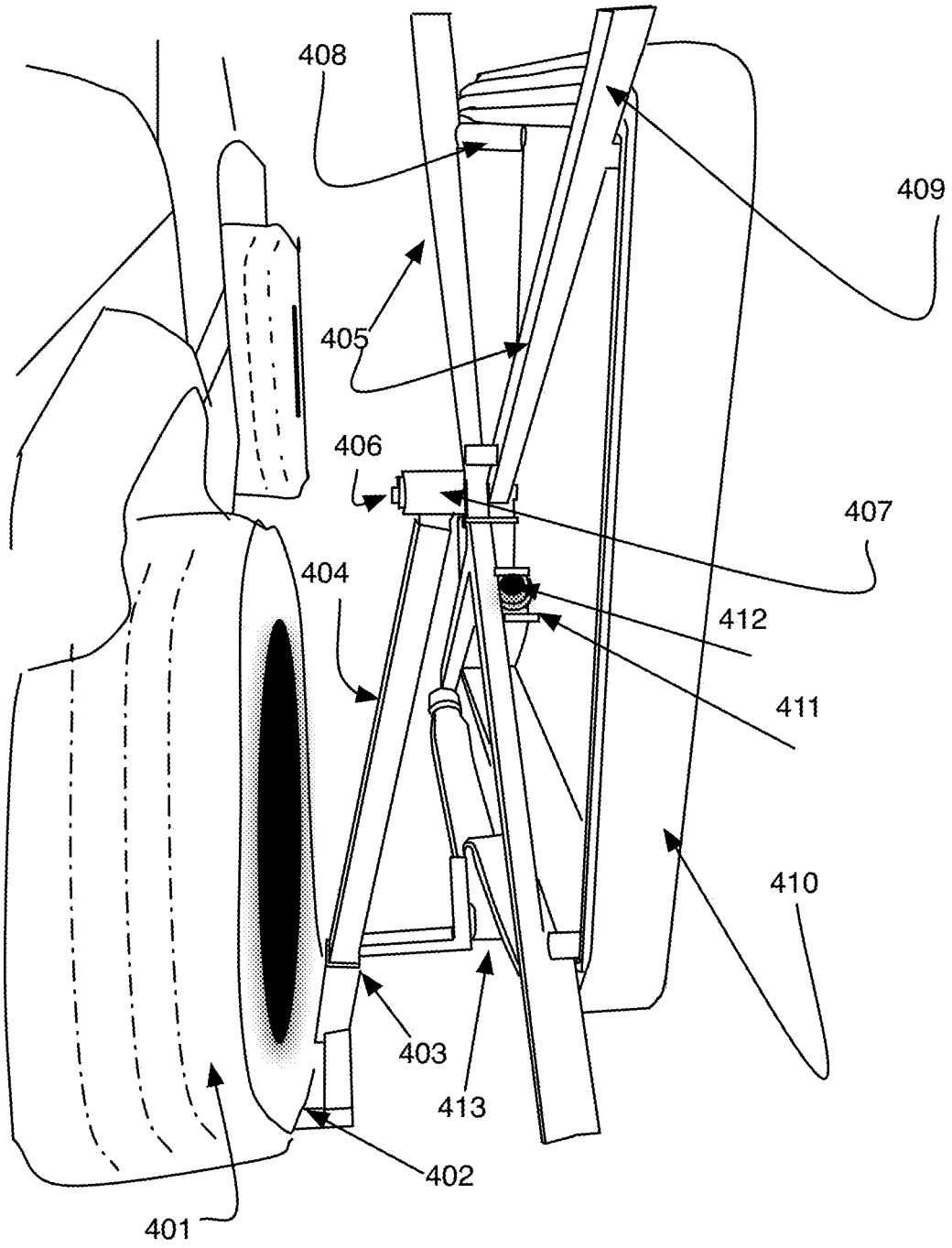
FIG. 4 shows a side view of an embodiment of the hose pack roller device being used to roll a hose pack.

FIG. 4 shows a side view of an embodiment of the hose pack roller device. This embodiment includes pegs 408 on a single side of the arms 405 rather than on both sides as was seen in FIG. 2. The wheel 401 of the vehicle is positioned on the rectangular base 402 securing the base in position. The base includes a receiver fitting 403 into which the support 404 is inserted the support further includes a cylinder 407 that receives a shaft 406 that is connected to the arms 405. The shaft 406 can rotate in the cylinder 407 thereby enabling the arms 405 to be rotated. AS the arms are rotated the hose 410 is wrapped over the pegs 408. This embodiment includes a pair of pegs 411 which are spaced to allow threading of the hose between the pegs but the spacing is smaller than the end fitting 412 of the hose. The hose is thereby held to the arms as they are rotated and the hose wraps over the pegs 408. Once the complete length of the hose is wrapped onto the hose roller pack, the hose is removed and folded into the pack as shown in FIG. 1. In this embodiment the ends of the arms 409 are not tapered to a point. In the preferred embodiment, shown in previous drawings, the ends of the arms 409 are tapered to a point.

Figure 5:
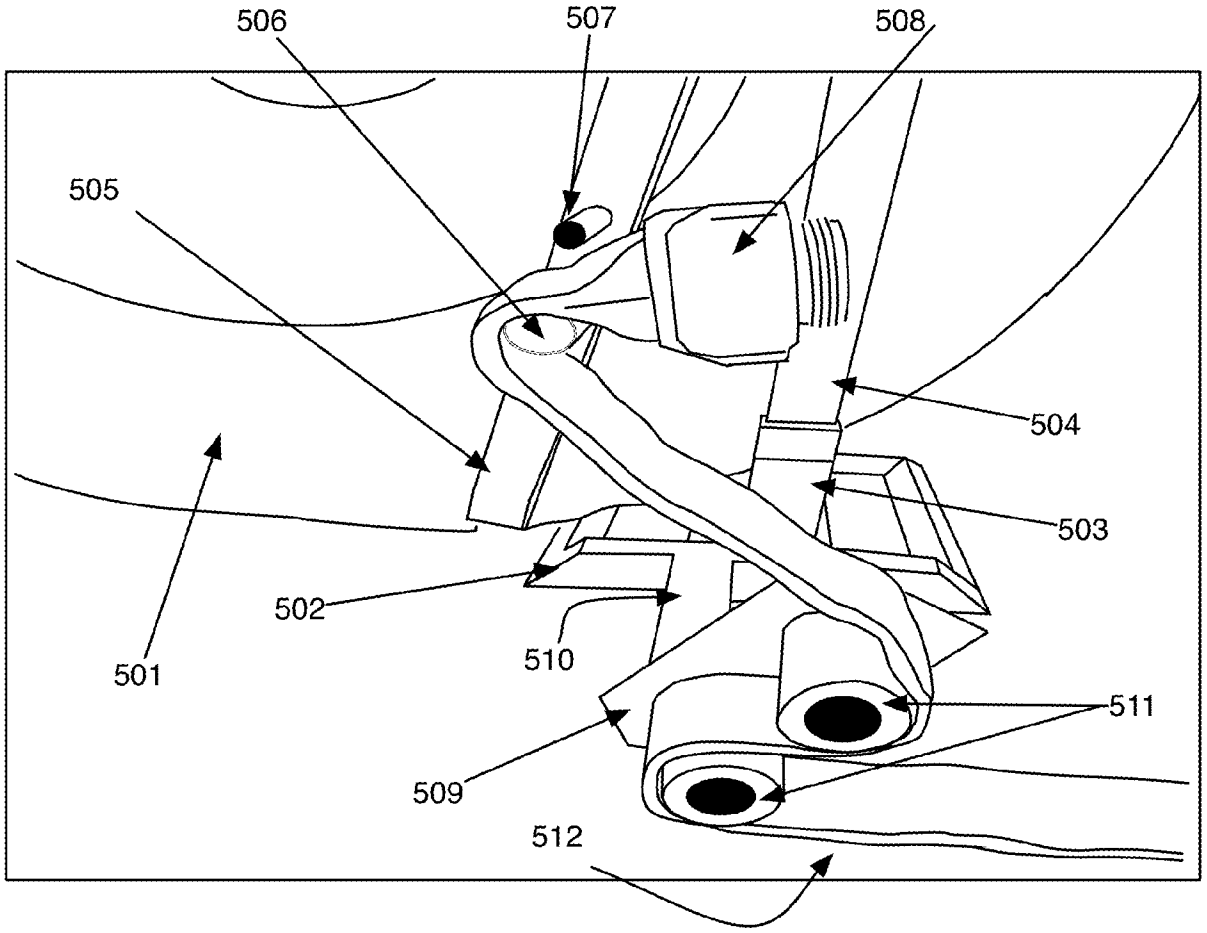
FIG. 5 shows a detailed view of the rollers used to squeeze air and water from the hose.

FIG. 5 shows details of the base and first roller pair. The tire 501 of the vehicle is positioned upon the rectangular base 502 to hold the fire hose pack roller in position while in use. The base further includes a receiver 503 into which the support rod for the arms (not wholly visible in this close-up view) is inserted. The receiver is a rectangular pipe whose inside dimensions are selected to allow insertion of the support shaft 504. The support base further includes a horizontal support shaft 510 to which is attached a bracket 509 and attached to the bracket are a pair of rollers 511. The fire hose 512 is threaded through the pair of rollers 511 and as the arm 505 is rotated the hose is pulled through the pair of rollers 511 thereby squeezing the hose 512 and expelling air and water from the hose as it is wrapped around the pegs 506 on the rotating arms 505 (only the end of one arm is seen in this view).

Figure 6:
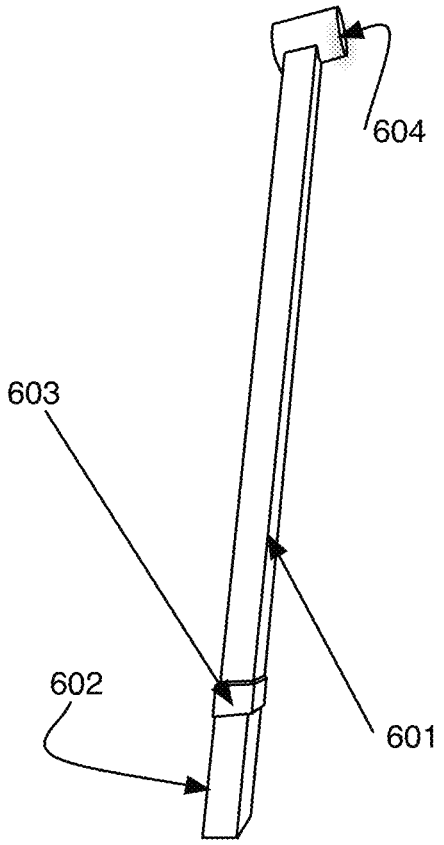
FIG. 6 shows separately the support for a three-component version of the device.
Figure 7:
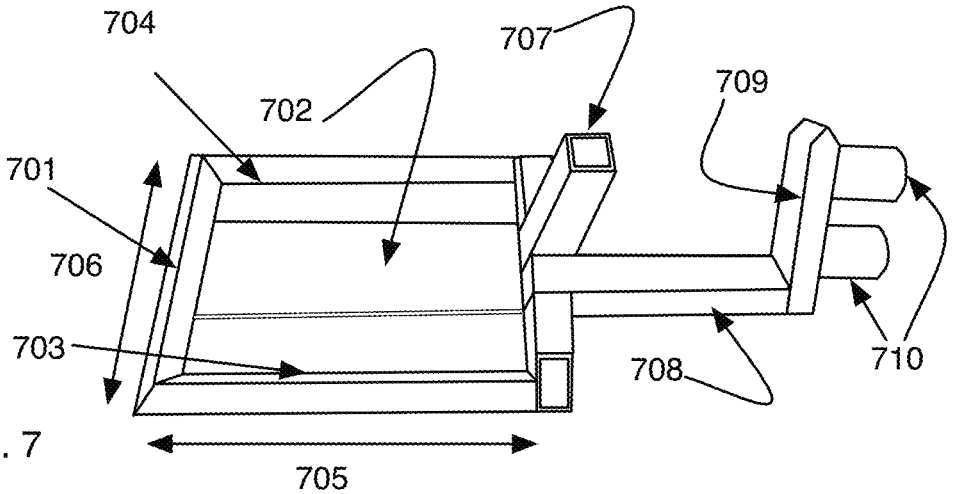
FIG. 7 shows the base of a three-component version of the device.
Figure 8:
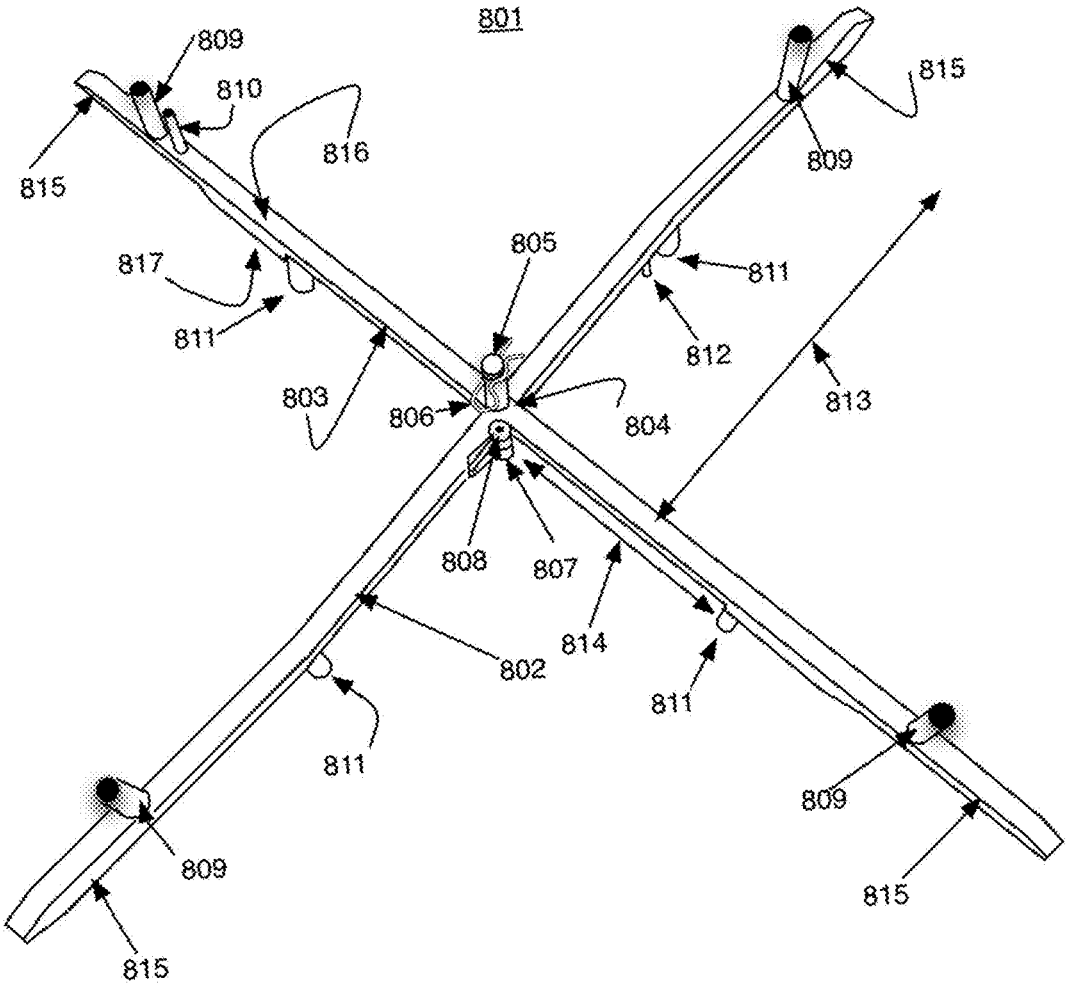
FIG. 8 shows the hose pack roller arms of the three-component version of the device in an open position for use.

FIGS. 6, 7, and, 8 show three components used in one embodiment of the fire hose pack roller. FIG. 6 shows the support shaft for the arms (FIG. 8). The support shaft is comprised of an elongated shaft 601 that includes a first end 602 that mates with the base support (FIG. 7) and a second end that includes a cylinder 604. The cylinder has a hollow center portion, not shown, into which is inserted a shaft attached to the arms (FIG. 8) such that the arms may be rotated. The support shaft further includes a circumferential enlarged section 603 that acts as a stop when the shaft is inserted into a receiving section on the base. The Shaft 601 is shown here, in the preferred embodiment, as having a rectangular shaped cross-section. Other shapes such as triangular, circular and ovoid may also be used.

FIG. 7 shows the details of the base component in the three-component embodiment of the fire hose pack roller. The base is comprised of a rectangular section 701 having a width 705 and a length 706. The width and length are chosen such that a vehicle may be positioned with its tire on the rectangular section to hold the base securely when using the fire hose pack roller. In the preferred embodiment the center portion of the rectangular base is empty and the base is made of tubing 704 shown here as having a rectangular cross-section. Other cross-sectional shapes such as triangular, circular and ovoid are also possible. The base further includes a receiver 707 that is sized to accept the support shaft (FIG. 6). The size of the receiver is selected such that the support shaft may be inserted into the receiver up to the stop 603 seen in the previous FIG. 6. The base further includes a horizontal arm 708 to which is attached a substantially vertical bracket 709 and attached to the bracket are a pair of horizontal rollers 710. The fire hose is threaded through the rollers 710 such that when the hose is pulled through the rollers air and water are squeezed from the hose as it is rolled up to make a hose pack.

The final component of the three-component embodiment includes the arms shown variously in FIGS. 8-12. The arms attach to the support shaft of FIG. 7. Referring to FIG. 8, the arms as they would appear extended for use, are seen. The arms 801 are comprised of two rectangular cross-section shafts 802, 803. In other embodiments (not shown) the cross sections may be circular triangular, ovoid or other shapes. The arms are joined at a center point 804 where a cylinder is attached, the cylinder forming a shaft that I s inserted into the end of the support shaft to allow rotations of the arms about the center in the plane formed by the two arms 802, 803. A removable clip 806 is included that is used to secure the shaft 805 in the cylinder 604 of support shaft (FIG. 6). Alignment cylinders 807, 808 are attached to each arm such that when the arms are fully open as shown the cylinders align and a pin is inserted through the center of the alignment cylinders to hold the arms in the open position. The arms include a first side 816 and an opposing second side 817. Pegs 809 are attached on the first side all spaced at an equal distance 813 from the center. In use, the rotation of the arms causes the fire hose (shown in previous Figures) to wrap over the pegs 809. In the embodiment shown the arms further include a set of pegs 811 similarly all spaced at an equal distance 814 from the center. Where the distances 814 and 813 are not equal. In the Figure shown the distance 814 is shorter and the pegs spaced at that distance from the center would be in use for rolling hose packs of hoses that are shorter in length than would be used on the pegs 809 of the opposing side. The embodiment shown can thereby accommodate two different hose lengths by mounting the arms on the support shaft with the appropriately selected side facing outward away from the vehicle (see FIGS. 3 and 4). One of the pegs on each side further includes a neighboring pin 810, 812 that is spaced away from the peg used for wrapping the hose 809, 811 at a distance through which the hose may pass but the end fitting on the hose cannot pass. Thus when initially threading the hose onto the hose pack roller for wrapping the end fitting will be caught and allow the hose to be pulled onto the pegs 809 or 811 as the arms are rotated in the plane of the figure. In another embodiment shown previously rather than a single "end capturing peg" 810 or 812, on each side of the arms there is a pair of such pegs and the end fitting of the hose is captured between this pair of pegs rather than between the end capturing peg 810 and the wrapping peg 809. The ends of each arm 815 are tapered to avoid snagging of the fire hose as it is wrapped onto the pegs 809 or 811.

Figure 9:
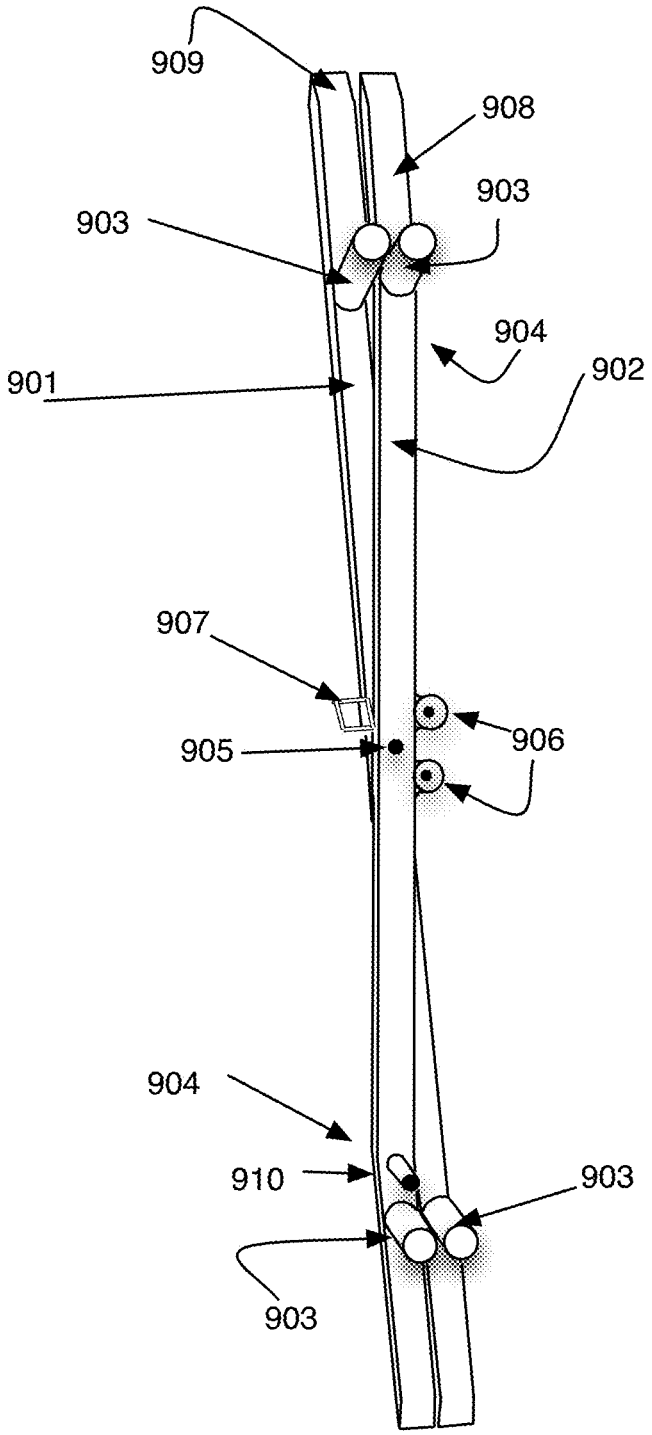
FIG. 9 shows the hose pack roller arms of the three-component version of the device in a folded or closed position as they would be for storage.
Figure 10:
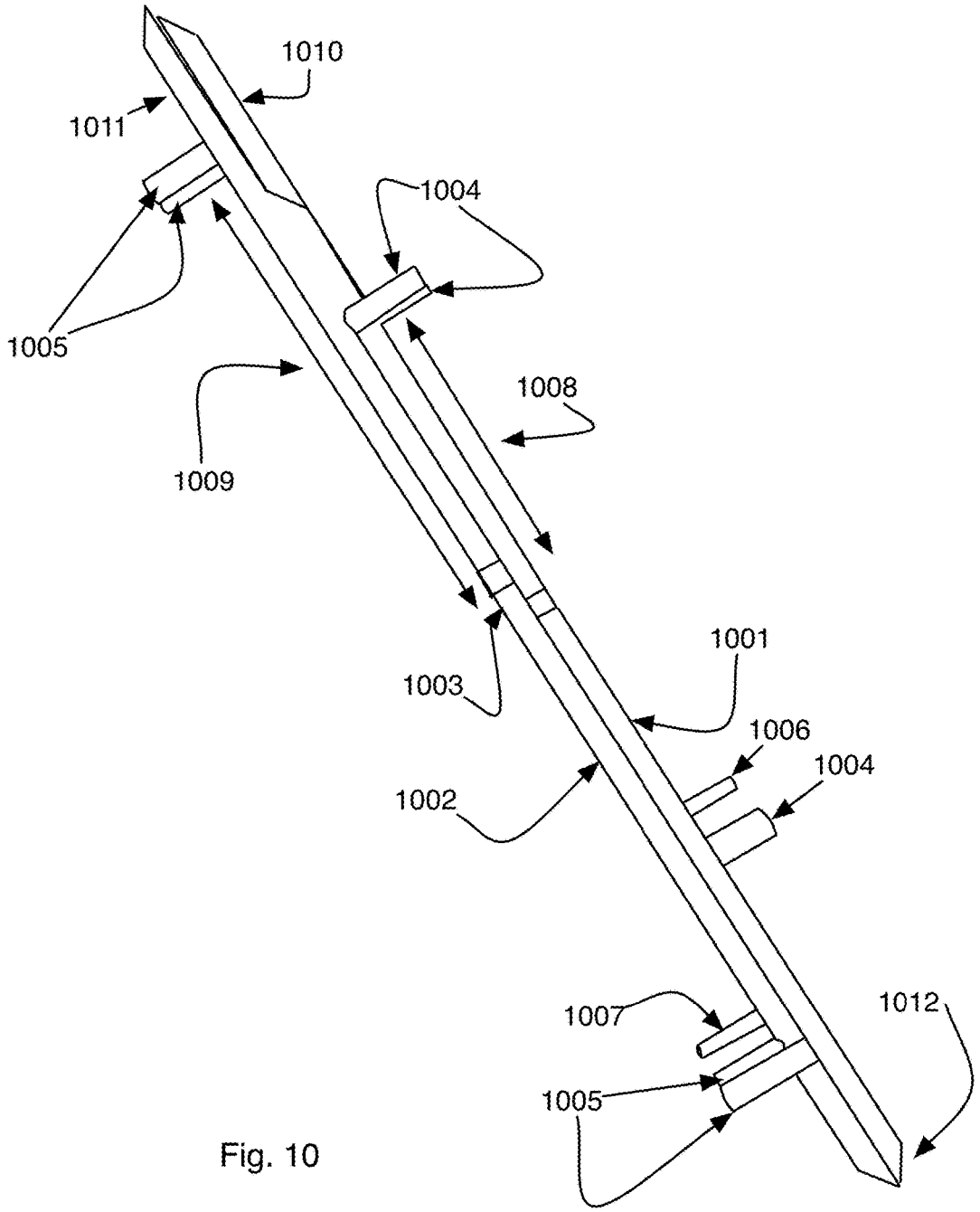
FIG. 10 shows is a side view of the hose pack roller arms of FIG. 9.

FIGS. 9 and 10 shows the arms of the fire hose pack roller as shown in FIG. 8 folded into a closed position for storage on the fire truck when not in use. The arms 901, 902 pivot about the center point that includes a shaft 905 that goes through both arms and holds them together as a unit. There is a slight bend 904 in the first arm 902 that results in the ends of the arms 908, 909 to be parallel and closed when folded. The other features already discussed include the two pegs 903 on each of the arms 901, 902 over which the hose is wrapped when the arms are in the open position. The alignment cylinders 906 one attached to each of the arms 901, 902 are more easily seen in this closed view of the arms. The cylinders align when the arms are fully opened to the stop 907 and a pin is placed through the center of the alignment cylinders to lock the arms in the open position for use. This embodiment includes a single additional peg 910 that is placed a distance from the peg 903 on the same arm that allows threading of the hose through the space between the two pegs but prevents passage of the hose end fitting (see FIG. 5). FIG. 10 shows a side view of the arms in the closed position. The two arms 1001, 1002 are pivotally joined at the midpoint 1003. This embodiment includes pegs 1004, 1005 on both sides of the arms the pegs 1004 are spaced a distance 1008 from the midpoint and the pegs 1005 are each spaced a distance 1009 from the midpoint. The pegs 1005 spaced a larger distance 1009 are used for longer hoses such as a high-rise hose while those spaced closer 1004 are used for shorter hoses such as wild-land hose packs. The widths of the arms are adjusted at the ends 1010, 1011 so that the arms fit snugly when rotated to the closed position. The ends of the arms 1012 are tapered so that the fire hose does not snag on the ends when being rolled up.

Figure 11:
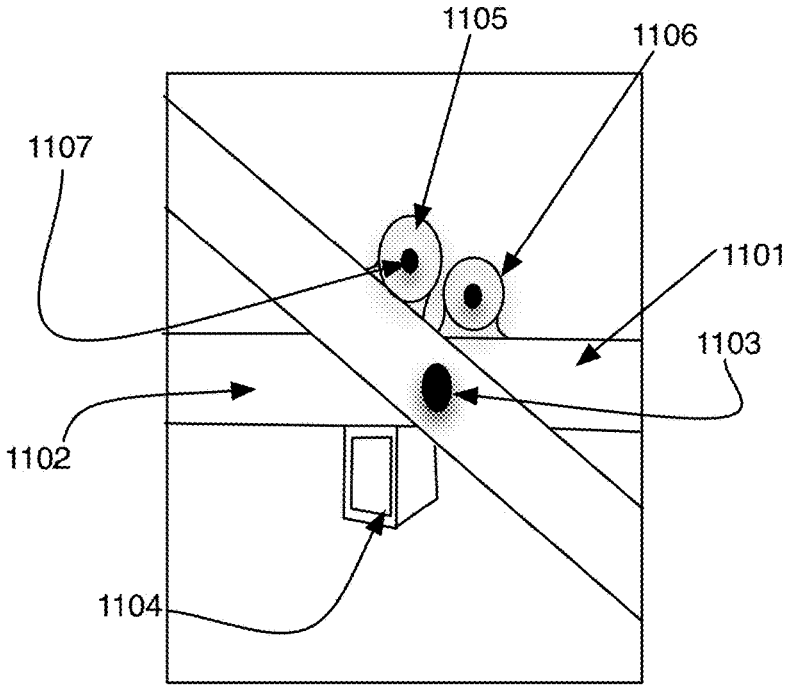
FIG. 11 shows details of the central region of the roller arms showing the pivot, a stop and a locking mechanism.
Figure 12:
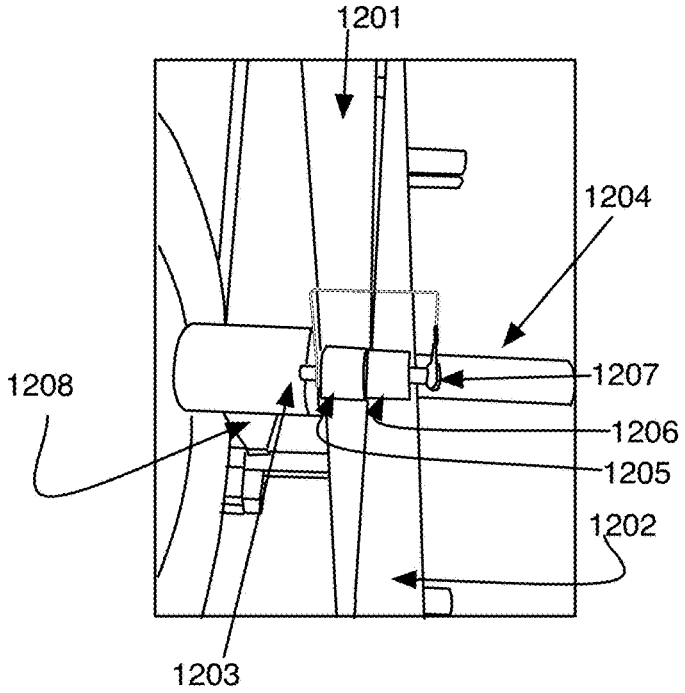
FIG. 12 shows a side view of the region of FIG. 11.

FIGS. 11 and 12 show the details of the center portion of the arms of the hose pack roller. The front view of FIG. 11 shows the two arms 1101, 1102 pivotally joined at the center point 1103 The arms are shown in a position part ways between fully opened and closed. The arms may be rotated to a fully opened position they will be orthogonal to one another and the stop 1104 will stop the arms from rotating beyond the orthogonal position. Once in the fully open orthogonal position, the alignment cylinders 1105, 1106 will line up and a pin is placed down the center 1107 traversing both pins 1105, 1106 to lock the arms in the open position for use.

FIG. 12 shows a side view of the center region of the arms of the fire hose pack roller. The arms 1201, 1202 are in the open orthogonal position and the alignment cylinders 1205, 1206 are aligned and locked in place with the pin 1207. The arms are rotatably attached to a shaft 1204 that is attached to a fitting 1208 that fits to the support shaft, as better seen in FIG. 2.

Figure 13:
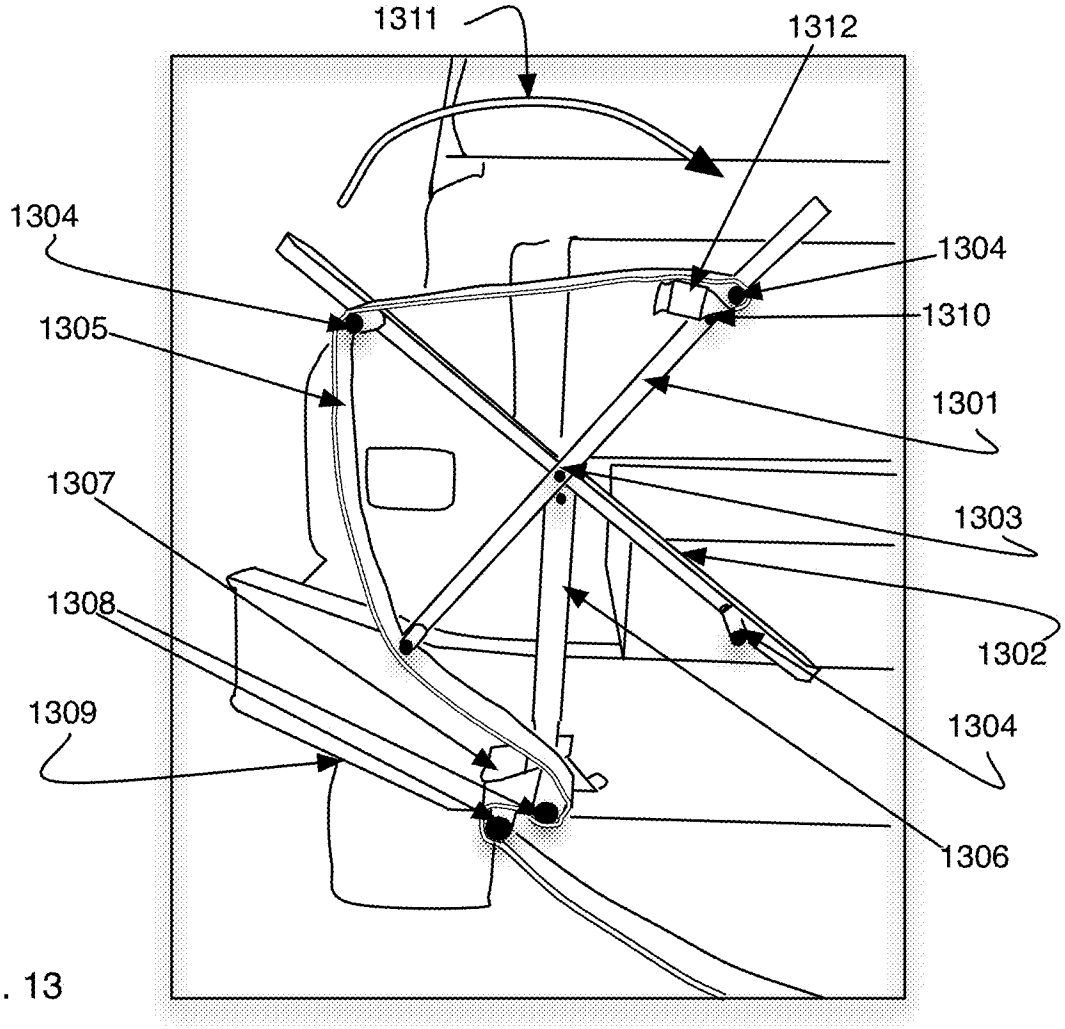
FIG. 13 shows another embodiment of the device that mounts to a vehicle, here shown mounted to a bumper on the fire truck.

FIG. 13 shows another embodiment of the fire hose stack roller in which the device is mounted to the vehicle. In the example shown the fire hose pack roller is mounted to the front bumper of a vehicle. The same mechanism could be used to mount the fire hose pack roller to any surface of the vehicle or to any vertical surface that provides clearance for rotation of the arms 1301, 1302 of the hose pack roller. This embodiment includes the now familiar parts: two arms 1301, 1302 pivotally joined at their centers 1303 and attached to a support shaft 1306 such that as the arms are rotated in the direction 1311 the hose 1305 is pulled through the pair of rollers 1308 and air and water are squeezed from the hose. The rotation causes the hose to wrap around the pegs 1304 forming a large coil that once the complete length of the hose is wrapped, the hose is removed and folded into the pack as shown in FIG. 1. The embodiment includes the peg 1310 spaced apart from the adjoining peg 1304 such that the hose fits through the space between the pegs but the end fitting 1312 on the hose does not thus securing the hose to the pack roller. A new feature of the embodiment is that support 1306 is removably fit to a bracket 1307 secured to the bumper of the vehicle. The bracket includes a receiver for the support shaft 1306 better seen in FIG. 14.

Figure 14:
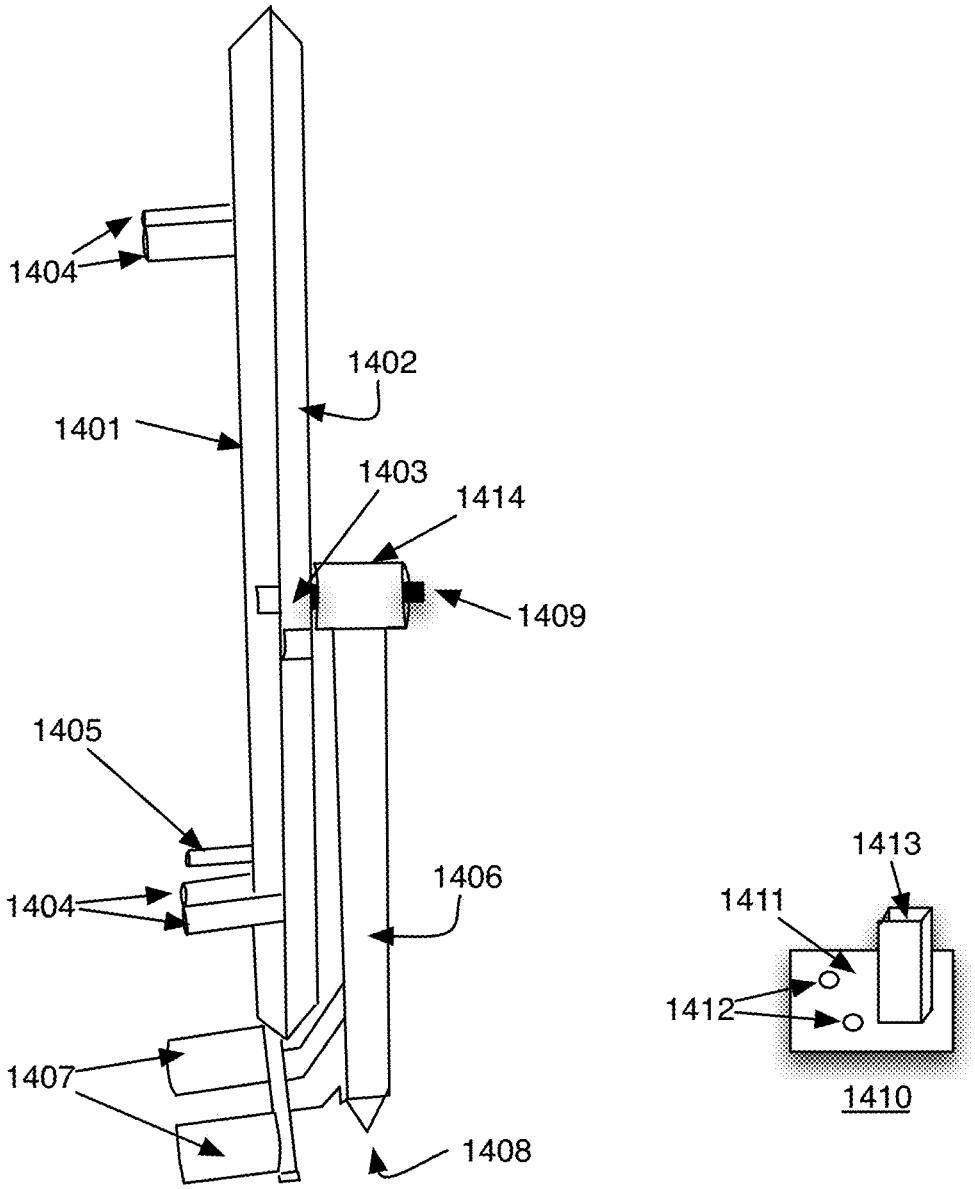
FIG. 14 shows another view of the device of FIG. 13 as it would be removed and folded for storage.

FIG. 14 shows the components of the bumper mounted embodiment of the fire hose pack roller. The embodiment includes two components in that the arms 1401, 1402 are permanently mounted to the support shaft 1406. The embodiment further includes a bracket 1410 that includes means for mounting to the vehicle. Here the means for mounting are holes 412 through which bolts may be inserted to mount the bracket to the vehicle. In the previous FIG. 13, the bracket is mounted to the front bumper of he vehicle. In other embodiments the bracket may be mounted practically anywhere on the vehicle that providers solid support and gives access to the arms 1401, 1402 for winding the fire hose. The bracket 1410 further includes a receiver 1413 for receiving the shaft 1406. The receiver in the example shown is a tube with a rectangular cross section that matches the cross-section of the shaft 1406 and is sized such that the end of the shaft 1408 may be inserted into the receiver 1413 to removably mount the shaft and therefore the hose pack roller device to the bracket. The shaft has a tapered end 1408 for easy insertion into the receiver 1413. The other components of this embodiment of the hose pack roller device are as previously described. The device is comprised of a pair of arms 1401, 1402 that are mounted at their center point 1403 to a shaft 1409. The shaft is mounted through a cylinder 1414 such that the shaft and the arms 1401, 1402 may be rotated to wind up the hose. The arms 1401, 1402 further include pegs 1404 around which the hose is wound and in this embodiment a single additional peg 1405 to capture the end fitting of the hose to hold the hose to the arms as they are rotated. A pair of rollers 1407 is also mounted to the shaft 1406. The hose is threaded through the rollers such that it is pulled through the rollers as the arms are rotated and thereby squeezes air and water from the hose as it is wound. The arms are extended such that they are approximately at a 90-degree angle from one another when in use and may be folded together, as shown in the FIG. 14, for storage. To use the device, the shaft 1406 is mounted in the bracket 1410 (which is mounted to the vehicle), the arms are extended to 90 degrees and locked in place by means previously described and the hose is threaded through the rollers 1407 and through the space between the peg 1405 and adjacent peg 1404. The space is such that the end fitting cannot be pulled through the space and as the arms are rotated the end fitting abuts against the peg 1405 and the nearest roller peg 1404 to pull the hose around and over all the pegs 1404. Once the full length of the hose is wound it is removed from the hose pack roller device and folded into the pack as shown in FIG. 1.

To summarize and noting that each of the drawings uses a number system that begins with the Figure number such that all items of FIG. 1 are number 1XX and all of FIG. 2 are 2XX and all of FIG. 10 are 10XX a Fire hose pack roller designed to make a pack similar to that shown in Figure is described.

The fire hose pack roller is comprised of:

a. two arms 202, 203, each of said arms comprised of elongated cylinders having a long axis and a cross-section, a center point along the long axis and distal ends 216 at each end of the long axis, b. the arms are mounted to an axle pin 204 at a center point of their long axis such that the arms can be rotated in a direction 217 perpendicular to their long axis, c. one of the arms includes a projection 215 near the center point of the long axis that acts as a stop such that the when rotated relative to one another are opened apart and when the stop is engaged the long axis of the arms form a ninety degree angle, d. the arms further include a pair of cylinders 906, one attached to each arm such that when the long axis of the arms form a ninety degree angle the cylinders align and a pin 1207 inserted through both cylinders locks the arms in position relative to one another with a ninety degree angle between their long axis, the arms still rotatable as a unit, e. a first set of four pegs 903 one attached near the distal end of each arm, the pegs projecting at ninety degrees from the long axis and perpendicular to a plane defined by the arms when locked with their long axis at degrees from one another, the pegs all projecting in the same direction from the plane, the pegs having a length that is approximately one inch longer than the width of the fire hose, f. at least one additional peg 507 attached to one of the arms and placed near to and parallel to the one of four pegs 506 attached to the same arm, said additional peg spaced apart from the one of four pegs such that the fire hose 512 will fit between the one additional peg and the one of four near to pegs and the end fitting 508 on the fire hose will not fit through the space thereby removably attaching the fire hose to the arms such that as the arms are rotated the hose is wrapped around the four pegs forming a overlapping loop of fire hose, g. a support rod 404 having a first end and a second end, the first end removably attached to the axle pin 406 and the second end removably fit to a support base, the support rod having a length greater than ½ the length of the arms such that the arms can be rotated about the axle pin when the first end is attached to the axle pin and the second end of the support rod is fitted to the base and the base is set upon the ground.

In one embodiment the base is meant to fit under the fire truck tire as in FIG. 4. Another embodiment further includes rollers 511 to squeeze the hose as it is rolled. Another embodiment replaces the base with a bracket 1410 that is comprised of a plate that is attached to a vehicle and a vertical support receiver extending from the base said vertical support receiver sized such that the support rod may be inserted into the vertical support receiver thereby removably mounting the fire hose pack roller to the base and holding the support rod in a vertical position when inserted into the vertical support receiver.

Some embodiments further include two sets of four pegs 1004, 1005 on either side of the arms. Where the distance 1009 between the pegs 1005 and the center on one side of the arms is different from the distance 1008 for the pegs 1004 on the opposite side of the arms.

SUMMARY

A fire hose pack roller is described. The fire hose pack roller includes a first embodiment where the device is held in place by a bracket positioned under a vehicle's tire and the weight of the vehicle secures the device for use or in a second embodiment where the device is removably mounted to the vehicle. The hose pack roller device includes a pair of collapsible arms that are unfolded and the fire hose is would around pegs mounted on the arms. The device further includes a set of rollers that squeezes air and water from the hose as it is wound. Once wound the hose is easily folded into a Gansner type pack for storage of the hose. The arms of the device may be folded closed such that the device forms a compact unit for storage. No external power supply is required. The present invention has been described in terms of the preferred embodiment and it is recognized that equivalents, alternatives and modifications, beyond those expressly stated, are possible and are within the scope of the attached claims.

What is claimed is:

1. A fire hose pack roller for rolling and packing a fire hose, said fire hose having a width and end-fittings, said fire hose pack roller comprised of:

a. two arms, each of said arms comprised of elongated cylinders having a long axis and a cross-section, a center point along the long axis and distal ends at each end of the long axis, b. the arms are mounted to an axle pin at a center point of the long axis such that the arms can be rotated in a direction perpendicular to the long axis, c. one of the arms includes a projection near the center point of the long axis that acts as a stop such that the when rotated relative to one another are opened apart and when the stop is engaged the long axis of the arms form a ninety degree angle, d. the arms further include a pair of cylinders, one attached to each arm such that when the long axis of the arms form a ninety degree angle the cylinders align and a pin inserted through both cylinders locks the arms in position relative to one another with a ninety degree angle between the long axis, the arms still rotatable as a unit, e. a first set of four pegs one attached near the distal end of each arm, the pegs projecting at ninety degrees from the long axis and perpendicular to a plane defined by the arms when locked with the long axis at degrees from one another, the pegs all projecting in the same direction from the plane, the pegs having a length that is approximately one inch longer than the width of the fire hose, f. at least one additional peg attached to one of the arms and placed near to and parallel to the one of four pegs attached to the same arm, said additional peg spaced apart from the one of four pegs such that the fire hose will fit between the one additional peg and the one of four near to pegs and the end fitting on the fire hose will not fit through the space thereby removably attaching the fire hose to the arms such that as the arms are rotated the hose is wrapped around the four pegs forming a overlapping loop of fire hose, g. a support rod having a first end and a second end, the first end removably attached to the axle pin and the second end removably fit to a support base, the support rod having a length greater than ½ the length of the arms such that the arms can be rotated about the axle pin when the first end is attached to the axle pin and the second end of the support rod is fitted to the base and the base is set upon the ground.

2. The fire hose pack roller of claim 1, wherein the base is comprised of:

a. a rectangle formed from metal rods said rectangle having a width and length such that the area within the rectangle is sized such that a vehicle tire when positioned upon the rectangle will firmly hold the base in position, b. a vertical support receiver extending from the base and perpendicular to the plane of the rectangle said vertical support receiver sized such that the support rod may be inserted into the vertical support receiver thereby removably mounting the fire hose pack roller to the base.

3. The fire hose pack roller of claim 2, wherein the base further includes a pair of rollers mounted perpendicular to the support rod, the rollers spaced apart such that when the fire hose is threaded through the rollers and the arms are rotated to wrap the hose around the four pegs the hose is squeezed as the hose passes through the rollers thereby removing air and water from the hose.

4. The fire hose of claim 2, further including a second set of four pegs, one attached near the distal end of each arm, the pegs projecting at ninety degrees from the long axis and perpendicular to a plane defined by the arms when locked with the long axis at degrees from one another, the pegs all projecting in the same direction from the plane, the pegs having a length that is approximately one inch longer than the width of the fire hose the second set of four pegs projecting on an opposite side of the arms from the first set of four pegs and the second set of four pegs each spaced a distance from the center of the arms and the distance of the second set of four pegs is different from the distance for the first set of four pegs.

5. The fire hose pack roller of claim 1, wherein the base is comprised of a plate that is attached to a vehicle and a vertical support receiver extending from the base said vertical support receiver sized such that the support rod may be inserted into the vertical support receiver thereby removably mounting the fire hose pack roller to the base and holding the support rod in a vertical position when inserted into the vertical support receiver.

6. The fire hose pack roller of claim 5, wherein the base further includes a pair of rollers mounted perpendicular to the vertical support receiver, the rollers spaced apart such that when the fire hose is threaded through the rollers and the arms are rotated to wrap the hose around the four pegs the hose is squeezed as the hose passes through the rollers thereby removing air and water from the hose.

* * * * *